US007971338B2

(12) United States Patent
Yang et al.

(10) Patent No.: US 7,971,338 B2
(45) Date of Patent: Jul. 5, 2011

(54) FABRICATING METHOD FOR EARPHONE

(75) Inventors: Chien-cheng Yang, Taichung (TW); Hui-yin Liang, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 345 days.

(21) Appl. No.: 12/169,022

(22) Filed: Jul. 8, 2008

(65) Prior Publication Data

US 2010/0008531 A1 Jan. 14, 2010

(51) Int. Cl.
*H04R 31/00* (2006.01)

(52) U.S. Cl. ..... 29/594; 29/592.1; 29/609.1; 381/313; 381/355; 381/356; 381/358; 381/360

(58) Field of Classification Search ..... 29/592.1, 29/594, 609, 609.1; 381/170, 313, 355, 356, 381/358, 360, 361, 368, 369, 380
See application file for complete search history.

(56) References Cited

U.S. PATENT DOCUMENTS 6,829,365 B1 * 12/2004 Kim ..... 381/370
7,116,795 B2 * 10/2006 Tuason et al. ..... 381/386
2006/0140434 A1 6/2006 Yang

FOREIGN PATENT DOCUMENTS

TW I265744 11/2006

* cited by examiner

*Primary Examiner* — Paul D Kim
(74) *Attorney, Agent, or Firm* — Chun-Ming Shih

(57) ABSTRACT

A fabricating method for an earphone includes the steps of: providing a front case and a speaker, the front case having a plurality of securing holes and a accommodating space, the speaker being disposed in the accommodating space; electrically connecting an earphone wire to the speaker; providing a rear case and securing the rear case onto the front case by making use of a plurality of fasteners penetrating through the rear case and fitted into the securing holes of the front case, and thereby the speaker is fixed in the accommodating space by the stop effect of the rear case; and buckling a protecting cover on the rear case to cover the fasteners. The fabricating method can make the produced earphone to be more reliable and thus can effectively avoid from being disassembled caused by an external force or unexpected falling, and therefore the internal components thereof can be effectively protected from damage.

21 Claims, 4 Drawing Sheets

FABRICATING METHOD FOR EARPHONE

BACKGROUND

The present invention relates to a fabricating method for an electronic device, especially to a fabricating method for an earphone.

Recently, electronics technology has known a rapid and a spectacular development leading to an availability of more small-typed electronic products to our life, such as radios, walkmans and so on. Further, personal digital electronic products, such as MP3 walkmans, mobile phones, personal digital assistant (PDA), or laptop computers and so on, are becoming more and more popular and indispensable in our daily life. Usually, for clearly hearing the music from the electronic products and do not disturb other people at the same time, earphones are necessary for users.

A traditional earphone mainly includes an earphone case and a speaker disposed in the earphone case. The earphone is composed of a front case and a rear case. The front case and the rear case are fixed to each other. For detail descriptions, please refer to Taiwan Patent No. I265744. However, the front case and the rear case of the earphone combining in this way are easily to be disassembled when they are inappropriately exerted or casually dropped by an ordinary user, causing invalidation of the internal components of the earphone.

BRIEF SUMMARY

It is an object of the present invention to provide a fabricating method to make the earphone to be more reliable, so as to solve the problem of the traditional earphone which can not avoid being disassembling by a user.

A fabricating method for an earphone of the present invention includes the following steps: affixing a non-woven fabric to a accommodating space of a front cover, disposing a speaker into the accommodating space; covering a windshield cap onto a sound output end of the front cover, wherein the front cover is engaged on a front fixing portion of a front base; electrically connecting an earphone wire to the speaker; fastening an ear-hook to the ear-hook fixing portion of the front base of the front case; aligning a disassembling hole of a rear case to one of the through holes of the front case, and securing the rear case onto the front case by making use of a plurality of fasteners penetrating through the rear case and fitted into the securing holes of the front case; and providing a protecting cover to be engaged on the rear case to cover the fasteners.

The rear case and the front case are assembled by the fasteners in the present invention, and covering the fasteners by the protecting cover buckled on the rear case. The present fabricating method can make the produced earphone to be more reliable and thus can effectively avoid from being disassembled caused by an external force or a non-external force, and therefore the internal components thereof can be effectively protected from damage.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
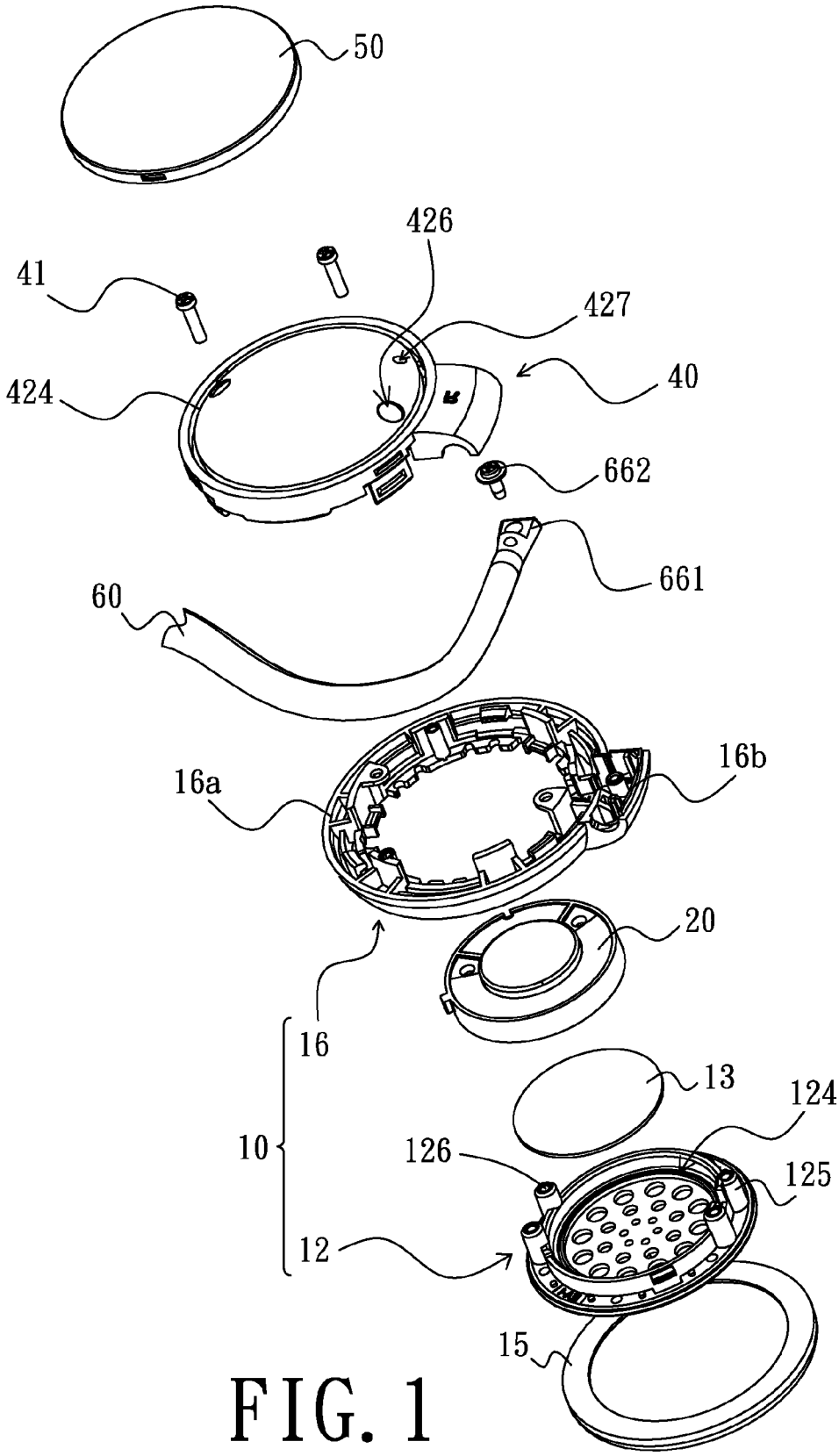
FIG. 1 is an isometric, exploded view of an earphone assembled by a fabricating method of the preferred embodiment of the present invention.

Referring to FIG. 1, an earphone includes a front case 10, a speaker 20, a rear case 40, a protecting cover 50 and an ear-hook 60.

The front case 10 includes a front cover 12 and a front base 16. The speaker 20 is placed between the front cover 12 and the front base 16.

The front cover 12 has an accommodating place 124 and a plurality of securing holes 126 along an outer edge of the front cover 12 outside the accommodating place 124. A non-woven fabric 13 is affixed in the accommodating space 124 of the front cover 12. A windshield cap 15 is covered on the front cover 12 at an opposite side of the accommodating space 124.

The front base 16 includes an annular front fixing portion 16*a* and an ear-hook fixing portion 16*b* outwardly extending from an outer edge of the front fixing portion 16*a*. Alternatively, the front fixing portion 16*a* of the front base 16 is capable of being engaged with the front cover 12 so that a component of the front case 10 and the speaker 20 is assembled. Alternatively, the front cover 12 and the front base 16 can be monolithically formed.

The rear case 40 includes a plurality of through holes 426 and an annular groove 424 outside the through holes 426. The through holes 426 transverse through the rear case 40 and are enclosed by the annular groove 424. The speaker 20 is mounted between the rear case 40 and the front case 10 by penetrating a plurality of fasteners 41 through the through holes 426 and fitting in the corresponding securing holes 126 of the front case 10. The fasteners 41 can be screws. Further, one of the through holes 426 is configured to a disassembling hole 427.

The protecting cover 50 is mounted to the annular groove 424 of the rear case 40 for covering the fasteners 41 and the disassembling hole 427 and being protected from outside damage.

A locating hole 661 is formed in one end of the ear-hook 60. A fastener 662 is fitted to the ear-hook fixing portion 16*b* of the front base 16 through the locating hole 661.

Figure 2:
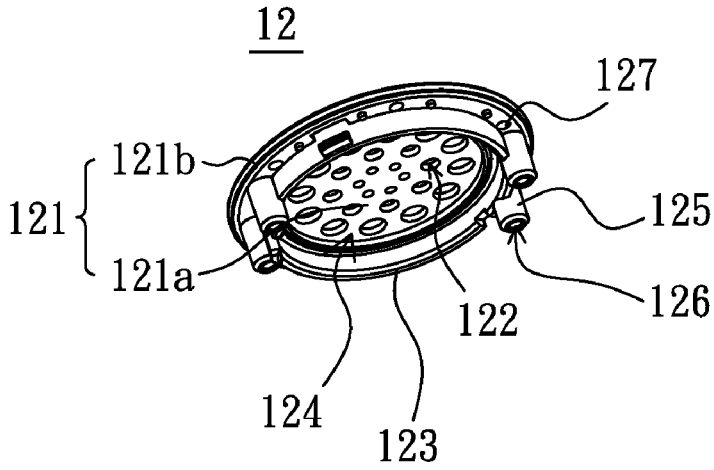
FIG. 2 is a schematic view of a front cover of the earphone depicted in FIG. 1.

Referring to FIG. 2, the front cover 12 includes a sound output end 121 and an annular flange 123 protruding from an inner side of the sound output end 121. The sound output end 121 includes a sound output member 121*a* and an assembling member 121*b* circling around the sound output member 121*a*. The sound output member 121*a* includes a plurality of sound output holes 122. The assembling member 121*b* protrudes a plurality of posts 125 from an inner side thereof and has a plurality of through holes 127 formed thereon. A height of each post 125 is higher than a height of the annular flange 123. The assembling member 121*b* and the sound output member 121*a* are monolithically formed. Each securing holes 126 are formed in each post 125. An opening direction of each securing hole 126 is positioned away from the assembling member 121*b*. The annular flange 123 is adjacent to the sound output member 121*a* and the assembling member 121*b*. The accommodating space 124 is formed by the enclosure of the annular flange 123 for accommodating the speaker 20.

Figure 3:
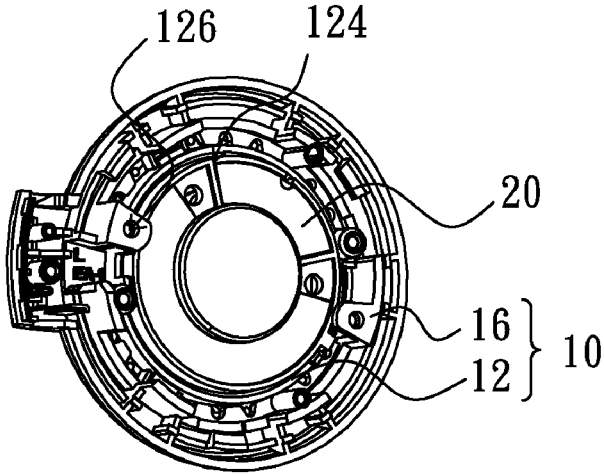
FIG. 3 is a schematic view of an assembly of the front case and a speaker depicted in FIG. 1.

Referring also to FIG. 3, an isometric and schematic view of a component of the front case 10 and the speaker 20 of the preferred embodiment of the present invention is shown, the speaker 20 is disposed in the accommodating space 124 of the front case 10.

Figure 4:
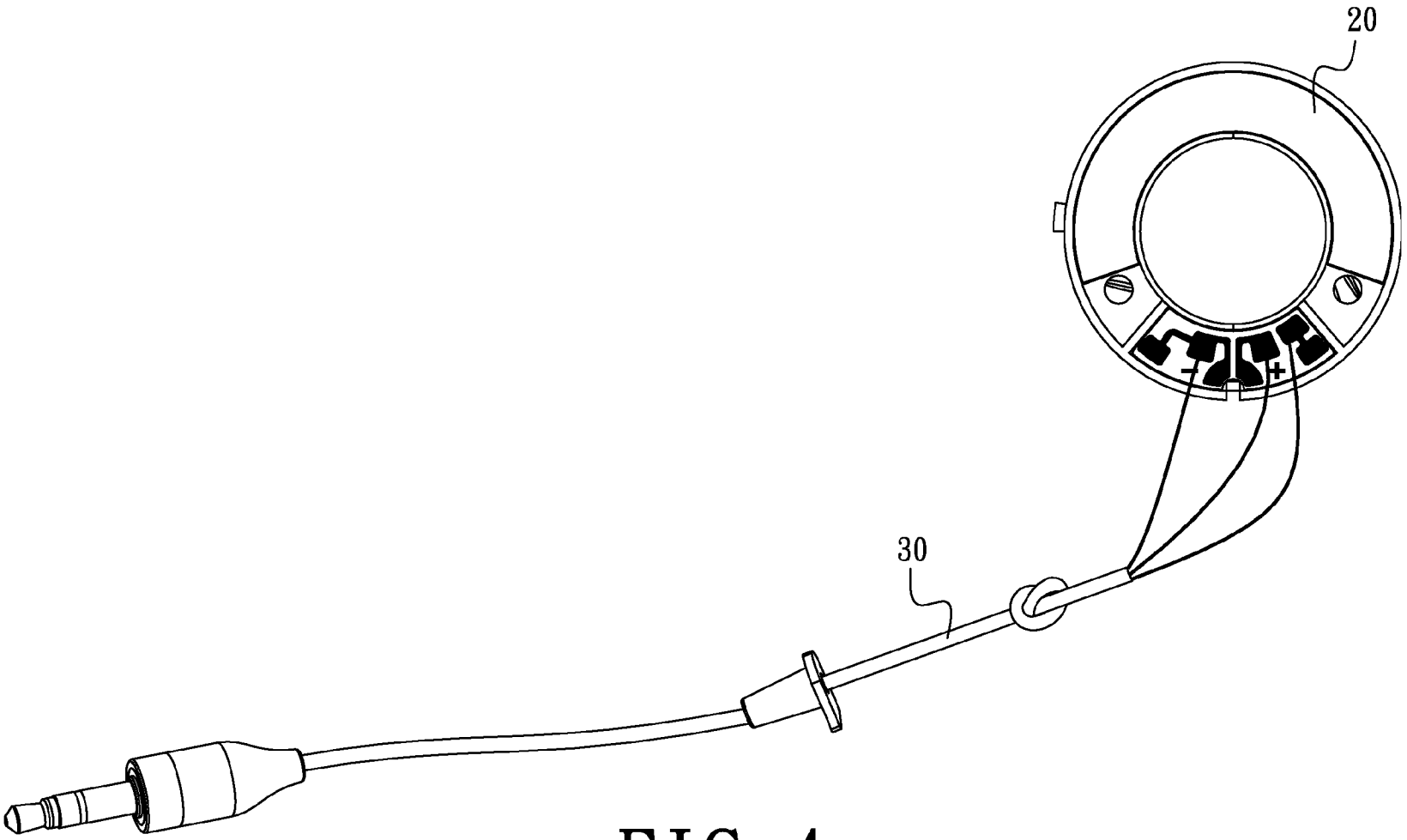
FIG. 4 is a partial sectional view of an earphone wire connected to the speaker of the preferred embodiment of the present invention.

Referring to FIG. 4, showing a partial sectional view of an earphone wire 30 which is electrically connected to the speaker 20 of the preferred embodiment of the present invention. The speaker 20 is capable of being electrically connected to the earphone wire 30 by welding. The earphone wire 30 can be a signal transmission wire between the speaker 20 and a digital electronic product such as MP3 player, mobile phone, PDA or notebook and so on.

Figure 5:
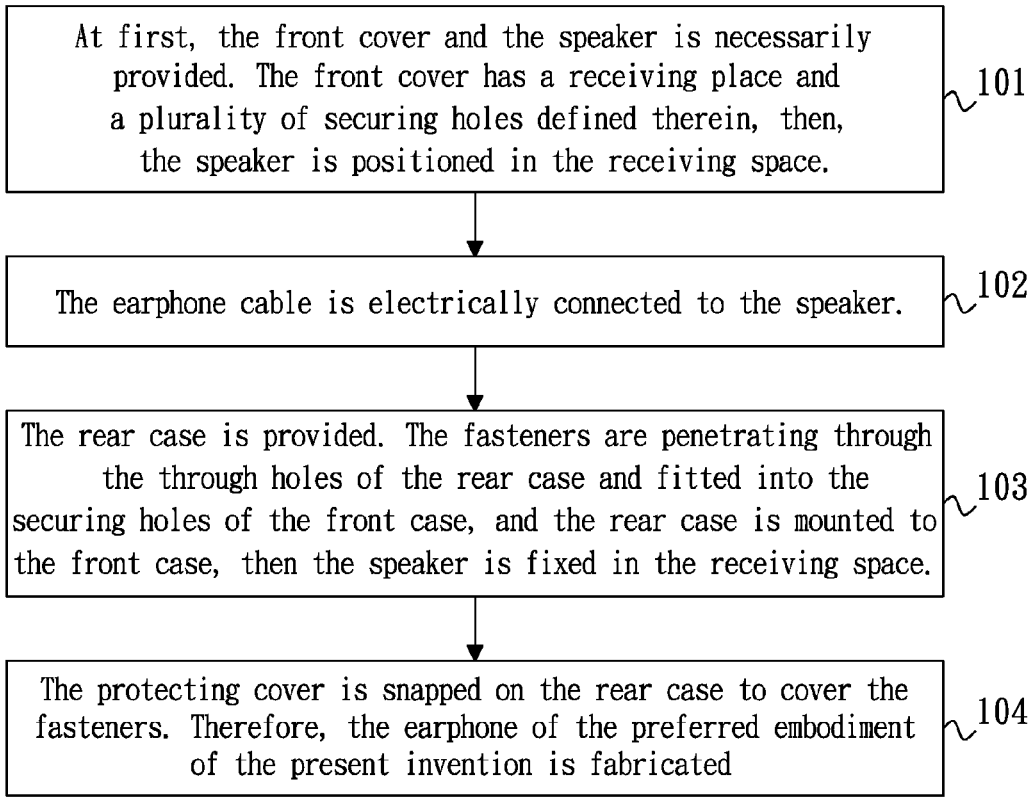
FIG. 5 is a flow chart of the fabricating method of the earphone of the preferred embodiment of the present invention.

Referring also to FIG. 5, a flow chart of a fabricating method of the preferred embodiment of the invention is shown, the fabricating method includes the following steps from a step 101 to a step 104 (the label of each part is shown in FIG. 1 to FIG. 4).

In the step 101, the non-woven fabric 13 is first affixed in the accommodating space 124 of the front cover 12 by glue, then, the speaker 20 is positioned in the accommodating space 124, and then, the windshield cap 15 is covered on a side of the front cover 12 away from the accommodating space 124, and then, the front cover 12 is engaged with the front fixing portion 16*a* of the front base 16.

In a step 102, the earphone wire 30 is electrically connected to the speaker 20.

In a step 103, the ear-hook 60 is fastened to the ear-hook fixing portion 16*b* of the front base 16, then, the fasteners 41 are penetrating through the corresponding through holes 426 of the rear case 40 and fitted into the securing holes 126 of the front case 10, and the rear case 40 is mounted to the front case 10.

In the step 104, the protecting cover 50 is snapped on the rear case 40 to cover the fasteners 41 to avoid disassembling by user. Therefore, the earphone of the preferred embodiment of the present invention is fabricated.

The rear case 40 is assembled to the front case 10 by screwing the fasteners 41, and the fasteners 41 is covered by the protecting cover 50 which is snapped on the rear case 40 in the preferred embodiment of the invention. Therefore, the present fabricating method can make the resultant earphone to be more firmly fixed together and thus can effectively avoid invalidation of the internal components caused by the damage of an external force or a non-external force. Furthermore, the disassembling hole 427 is disposed in a relative concealed position, and when the disassembling hole 427 is aligned with one of the through holes 127 of the front case 10, the earphone is then capable of being effectively disassembled, and thus can avoid discretionarily disassembling the earphone by an ordinary user, and facilitate the maintenance by a professional.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A fabricating method for an earphone, comprising the steps of:

(a) providing a front case and a speaker, the front case including a front cover and a front base, the front cover having an accommodating space and a plurality of securing holes configured therein, and comprising a sound output end and an annular flange protruding from an inner side of the sound output end, the speaker being disposed in the accommodating space;

(b) providing an earphone wire, the earphone wire being electrically connected to the speaker;

(c) providing a rear case and securing the rear case onto the front case by making use of a plurality of fasteners penetrating through the rear case and fitted into the securing holes of the front case, thereby the speaker being fixed in the accommodating space; and (d) providing a protecting cover being engaged on the rear case to cover the fasteners.

2. The fabricating method as claimed in claim 1, wherein the front base comprises an annular front fixing portion.

3. The fabricating method as claimed in claim 2, wherein the step (a) further comprises: (a1)) fabricating the front cover to the front fixing portion of the front base.

4. The fabricating method as claimed in claim 3, wherein the front cover is mounted to the front fixing portion by buckling.

5. The fabricating method as claimed in claim 3, further comprising a step performed before the step (a1): mounting a windshield cover to the front cover at a side opposite to the accommodating space.

6. The fabricating method as claimed in claim 2, wherein the front base comprises an ear-hook fixing portion outwardly extending from an outer edge of the front fixing portion.

7. The fabricating method as claimed in claim 6, further comprising a step performed before the step (c): securing an ear-hook to the ear-hook fixing portion.

8. The fabricating method as claimed in claim 1, wherein the front cover and the front base are monolithically formed.

9. The fabricating method as claimed in claim 1, wherein the sound output end comprises a sound output member and an assembling member circling around the sound output member, the annular flange is adjacent to the sound output member and the assembling member and forms the accommodating space, and the securing holes are formed in the assembling member.

10. The fabricating method as claimed in claim 9, wherein a plurality of posts is protruded from an inner side of the assembling member, and the securing holes are formed in the posts away from the assembling member.

11. The fabricating method as claimed in claim 10, wherein a height of each post is larger than a height of the annular flange.

12. The fabricating method as claimed in claim 1, further comprising a non-woven fabric disposed between the front cover and the speaker.

13. The fabricating method as claimed in claim 12, wherein the non-woven fabric is affixed in the front cover.

14. The fabricating method as claimed in claim 1, wherein the earphone wire is electrically connected to the speaker by welding.

15. The fabricating method as claimed in claim 1, wherein a plurality of through holes are formed in the rear case.

16. The fabricating method as claimed in claim 15, wherein the step (c) further comprises:

(c1) aligning the through holes of the rear case to the corresponding securing holes of the front case; and (c2) securing the rear case to the front case via the fasteners penetrating through the through holes and fitting into the corresponding securing holes of the front case.

17. The fabricating method as claimed in claim 15, wherein the rear case further comprises an annular groove for the protecting cover to be engaged therein.

18. The fabricating method as claimed in claim 1, wherein the fasteners are screws.

19. A fabricating method for an earphone, comprising the steps of:

(a) providing a front case and a speaker, the front case including a front cover, a front base and a non-woven fabric, the front cover having an accommodating space and a plurality of securing holes configured therein, the speaker being disposed in the accommodating space, the non-woven fabric being disposed between the front cover and the speaker;

(b) providing an earphone wire, the earphone wire being electrically connected to the speaker;

(c) providing a rear case and securing the rear case onto the front case by making use of a plurality of fasteners penetrating through the rear case and fitted into the securing holes of the front case, thereby the speaker being fixed in the accommodating space; and (d) providing a protecting cover being engaged on the rear case to cover the fasteners.

20. A fabricating method for an earphone, comprising the steps of:

(a) providing a front case and a speaker, the front case including a front cover and a front base, the front cover having an accommodating space and a plurality of securing holes configured therein, the front base comprising an annular front fixing portion, the speaker being disposed in the accommodating space;

(b) providing an earphone wire, the earphone wire being electrically connected to the speaker;

(c) providing a rear case and securing the rear case onto the front case by making use of a plurality of fasteners penetrating through the rear case and fitted into the securing holes of the front case, thereby the speaker being fixed in the accommodating space; and (d) providing a protecting cover being engaged on the rear case to cover the fasteners, wherein, the step (a) further comprises: (a1)) fabricating the front cover to the front fixing portion of the front base, and the fabricating method for the earphone further comprises a step performed before the step (a1): mounting a windshield cover to the front cover at a side opposite to the accommodating space.

21. A fabricating method for an earphone, comprising the steps of:

(a) providing a front case and a speaker, the front case including a front cover and a front base, the front cover having an accommodating space and a plurality of securing holes configured therein, the front base comprising an annular front fixing portion and an ear-hook fixing portion outwardly extending from an outer edge of the front fixing portion, the speaker being disposed in the accommodating space;

(b) providing an earphone wire, the earphone wire being electrically connected to the speaker;

(c) providing a rear case and securing the rear case onto the front case by making use of a plurality of fasteners penetrating through the rear case and fitted into the securing holes of the front case, thereby the speaker being fixed in the accommodating space; and (d) providing a protecting cover being engaged on the rear case to cover the fasteners.

* * * * *